US007541899B2

(12) United States Patent
Ahn

(10) Patent No.: US 7,541,899 B2
(45) Date of Patent: Jun. 2, 2009

(54) MULTI-POLE CIRCUIT BREAKER AND APPARATUS FOR PREVENTING DEFORMATION OF DRIVING SHAFT THEREOF

(75) Inventor: Byoung-Soo Ahn, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/535,183

(22) Filed: Sep. 26, 2006

(65) Prior Publication Data

US 2007/0075808 A1 Apr. 5, 2007

(30) Foreign Application Priority Data

Oct. 5, 2005 (KR) ..... 10-2005-0093582

(51) Int. Cl.
*H01H 75/00* (2006.01)
*H01H 77/00* (2006.01)
*H01H 83/00* (2006.01)

(52) U.S. Cl. ..... 335/8; 335/6; 335/9; 335/10; 335/11; 335/14; 335/22; 335/85; 335/89; 335/106; 335/112; 335/189; 335/190; 335/194

(58) Field of Classification Search ..... 335/6, 335/8–11, 14, 22, 85, 89, 106, 112, 189, 335/190, 194
See application file for complete search history.

(56) References Cited

U.S. PATENT DOCUMENTS 3,098,911 A * 7/1963 Schwartz et al. ..... 335/9
3,332,043 A * 7/1967 Camp ..... 335/71
3,752,947 A 8/1973 Strobel
4,600,908 A * 7/1986 Uchida et al. ..... 335/8
5,199,553 A * 4/1993 Shinohara et al. ..... 200/265
5,395,079 A * 3/1995 Jensen et al. ..... 248/62
5,480,193 A * 1/1996 Echols et al. ..... 285/45
5,898,146 A * 4/1999 Beck et al. ..... 200/401
6,259,338 B1 * 7/2001 Boeder et al. ..... 335/6
6,459,059 B1 10/2002 Greenberg et al.
6,771,151 B1 * 8/2004 Bach et al. ..... 335/8
6,933,814 B2 * 8/2005 Ciarcia et al. ..... 335/8
2002/0153978 A1 * 10/2002 Greenberg et al. ..... 335/8
2004/0227598 A1 * 11/2004 Ciarcia et al. ..... 335/8
2007/0075047 A1 * 4/2007 Oh ..... 218/154

FOREIGN PATENT DOCUMENTS

EP 1003192 5/2000
WO 02/082487 10/2002

* cited by examiner

*Primary Examiner*—Elvin G Enad
*Assistant Examiner*—Mohamad A Musleh
(74) *Attorney, Agent, or Firm*—Greenblum & Bernstein, P.L.C.

(57) ABSTRACT

Disclosed are a multi-pole circuit breaker and an apparatus for preventing deformation of a driving shaft thereof. The multi-pole circuit breaker includes: a plurality of single pole breaking units having a pair of fixed contactors, a movable contactor, and shafts; a switching mechanism disposed on a certain one of the plurality of single pole breaking units; a pair of driving shafts connected to each shaft; and a driving shaft deformation prevention unit disposed between the single pole breaking unit, spaced relatively far from the switching unit among the plurality of single pole breaking units, and the adjacent single pole breaking unit.

8 Claims, 10 Drawing Sheets

MULTI-POLE CIRCUIT BREAKER AND APPARATUS FOR PREVENTING DEFORMATION OF DRIVING SHAFT THEREOF

BACKGROUND OF THE INVENTION

1. Field of the Invention

The present invention relates to a multi-pole circuit breaker and an apparatus for preventing deformation of a driving shaft thereof, and more particularly, to a multi-pole circuit breaker, which can ensure circuit breaking performance and the reliability of the product by preventing deformation of a driving shaft, and an apparatus for preventing deformation of a driving shaft thereof.

2. Description of the Conventional Art

In general, a circuit breaker is an electrical device that protects a load and a line by manually or automatically breaking the line in the event of an abnormal condition such as an overload and short-circuiting of the line.

FIG. 1 is a perspective view illustrating a conventional multi-pole circuit breaker. FIG, 2 is an exploded perspective view illustrating a conventional multi-pole circuit breaker. FIG. 3 is a side view illustrating a conventional multi-pole circuit breaker. FIG. 4 is a perspective view showing the deformation of a driving shaft in a conventional multi-pole circuit breaker.

As illustrated in FIGS. 1 to 4, the conventional multi-pole circuit breaker 1 includes four single pole breaking units 10*a*, 10*b*, 10*c*, and 10*d*, that is, a single pole breaking unit 10*a* of R phase, a single pole breaking unit 10*b* of S phase, a single pole breaking unit 10*c* of T phase, and a single pole breaking unit 10*d* of N phase.

Each of the single pole breaking units includes a case 20 having a space, fixed contactors 41 installed in the case 20 with a predetermined distance, a movable contactor 42 rotatably disposed between the fixed contactors 41 by shafts 53, a trip mechanism (not shown) for tripping the circuit breaker by detecting a large current flowing through the circuit, a switching mechanism 50 automatically operated by the trip mechanism or manually operated by operating a handle 51, for separating the movable contactor 42 from the fixed contactors 41 thereby cutting off a circuit, and an arc extinguishing mechanism 60 for extinguishing arc gas of a high temperature and a high pressure generated between movable contactor 42 and the fixed contacts 41 at the time of switching a circuit.

The switching mechanism 50 includes a handle 51, an upper link (not shown) coupled to the trip mechanism, a lower link (not shown) coupled in conjunction with the lower part of the upper link, and driving shafts 52 for commonly connecting the lower link and the shaft 53 of each single pole breaking unit so that the shaft 53 of each single pole breaking unit can rotate in conjunction with the lower link.

In the thus-constructed conventional multi-pole circuit breaker, when a normal current flows on a circuit, the movable contactor 42 is in contact with fixed contactors 41 thereby to maintain a closed circuit state.

On the other hand, when a large current flows on the circuit abnormally while a circuit is in an ON state, the circuit breaker is tripped. At this time, the upper link and the lower link are rotated. As the lower link is rotated, the shaft 53 coupled thereto through the driving shaft 52 rotates in a clockwise direction. At this time, the movable contactor 42 is separated from the fixed contactors 41 to thereby maintain an opened circuit state.

However, in the conventional multi-pole circuit breaker, the switching mechanism 50 is not installed at the middle of the circuit breaker but installed biased to one side, that is to say, at the single pole breaking unit 10*b* of S phase corresponding to the second right one, as illustrated in FIGS. 1 and 2, of the four single pole breaking units 10*a*, 10*b*, 10*c*, and 10*d* to thereby make unbalanced the force applied to each of the single pole breaking units 10*a*, 10*b*, 10*c*, and 10*d* by the switching mechanism 50.

Subsequently, there occurs a problem that, as shown in FIG. 4, end portions of the driving shafts 52 are deformed as they are bent in a clockwise direction. Hence, the shaft installed at the single pole breaking unit 10*d* of N phase has a smaller amount of rotation as compared to the shafts installed at the other single pole breaking units 10*a*, 10*b*, and 10*c*, and as a result, the contact and separation performance between the fixed contactors 41 and the movable contactor 42 and the reliability of the product are deteriorated.

SUMMARY OF THE INVENTION

Therefore, the present invention has been made in an effort to solve the above-described problems, and has for its object to provide a multi-pole circuit breaker, which can effectively prevent deformation of a driving shaft by installing a driving shaft deformation prevention unit at an end portion of the driving shaft of a single pole breaking unit positioned relatively far from a switching mechanism, and an apparatus for preventing deformation of a driving shaft thereof.

To achieve the above-described object, there is provided a multi-pole circuit breaker in accordance with the present invention, including: a plurality of single pole breaking units having a pair of fixed contactors, a movable contactor selectively contacted with the pair of fixed contactors, and shafts for rotatably supporting the movable contactor; a switching mechanism disposed on a certain one of the plurality of single pole breaking units in order to selectively cut off a circuit; a pair of driving shafts connected to each shaft in order to simultaneously transmit a rotation force generated by the switching mechanism to the shaft of each single pole breaking unit; and a driving shaft deformation prevention unit disposed between the single pole breaking unit, spaced relatively far from the switching mechanism among the plurality of single breaking units, and the adjacent single pole breaking unit.

Furthermore, an apparatus for preventing deformation of a driving shaft of a multi-pole circuit breaker of the present invention includes: a pair of supporting blocks positioned to face each other with the driving shafts disposed therebetween so as to prevent deformation of the driving shafts; and a fastening member for fastening the pair of supporting blocks to each other and pressurizing the driving shafts positioned between the pair of supporting blocks.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A multi-pole circuit breaker and an apparatus for preventing deformation of a driving shaft of a multi-pole circuit breaker in accordance with preferred embodiments of the present invention will be described in detail with reference to the accompanying drawings.

Figure 5:
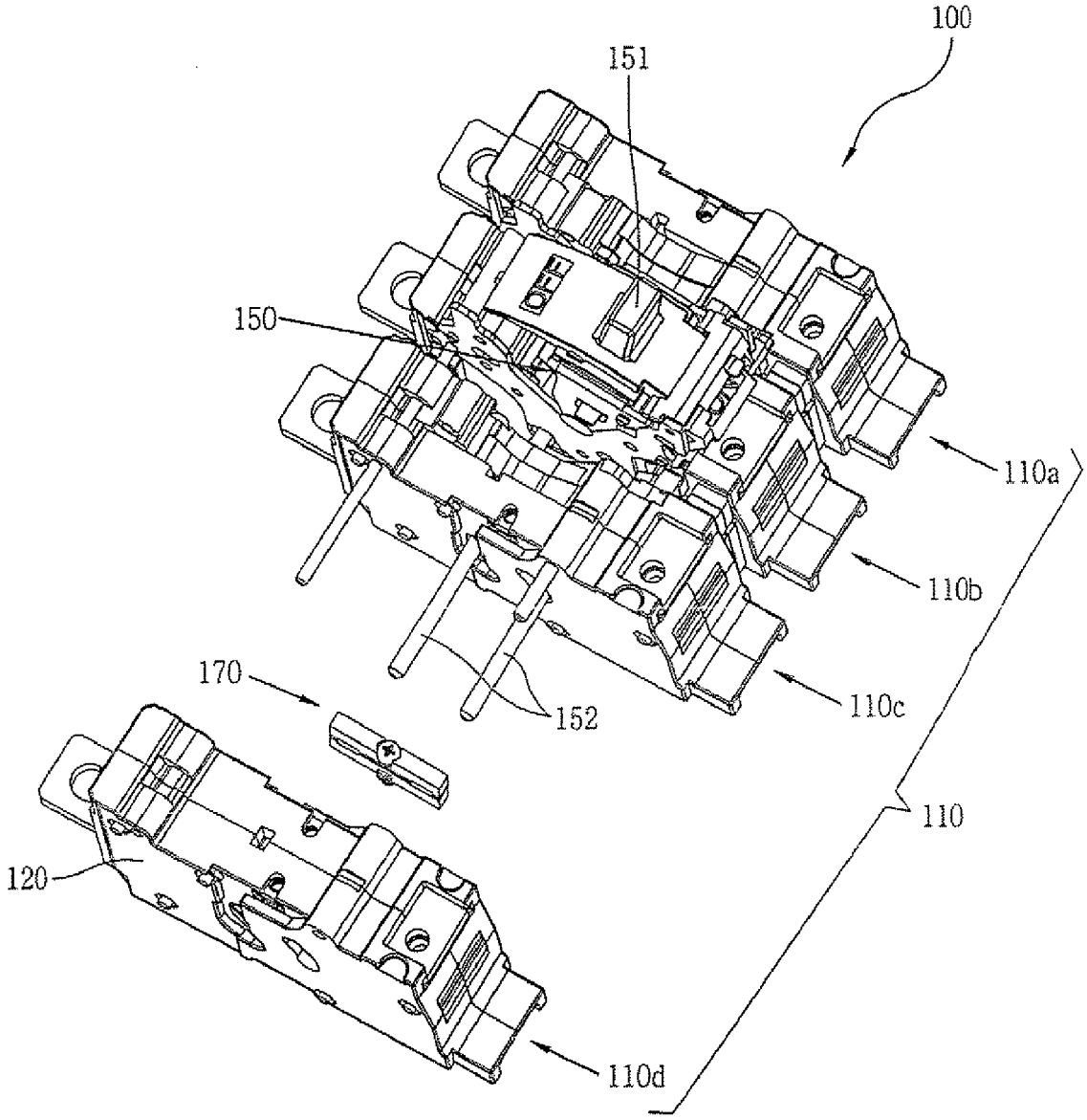
FIGS. 5 and 6 are perspective views illustrating a multi-pole circuit breaker in accordance with the present invention.
Figure 6:
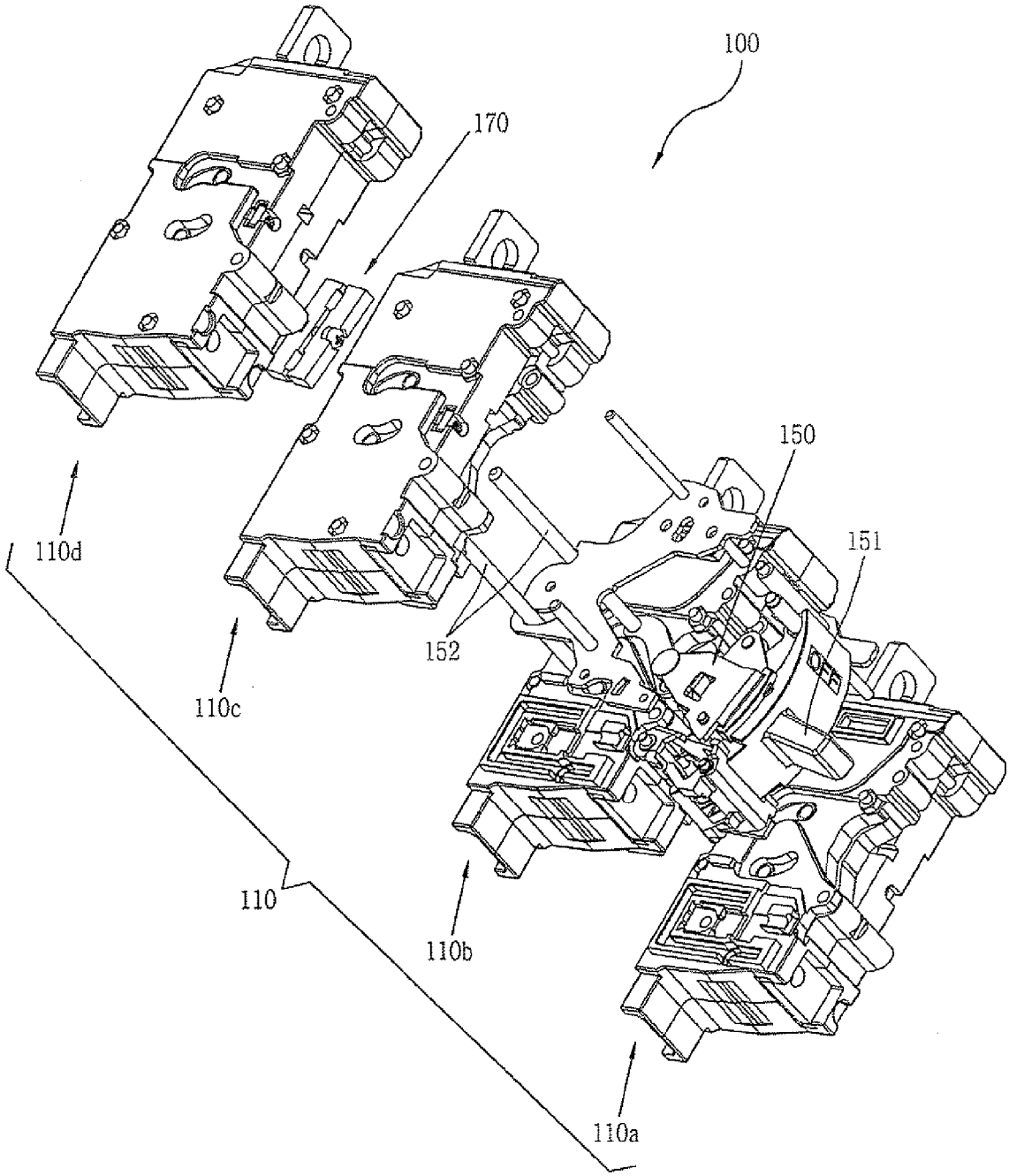
Figure 7:
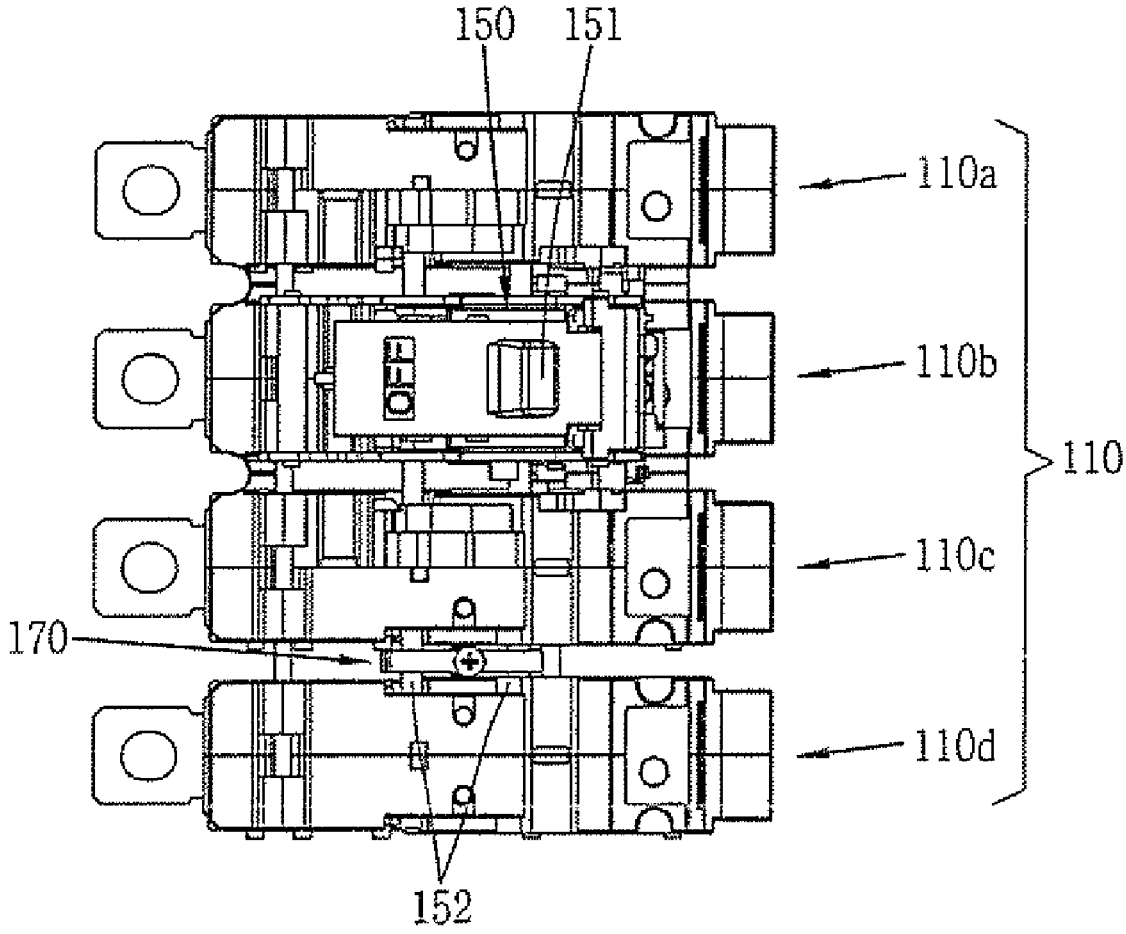
FIG. 7 is a plane view illustrating a multi-pole circuit breaker in accordance with the present invention.
Figure 8:
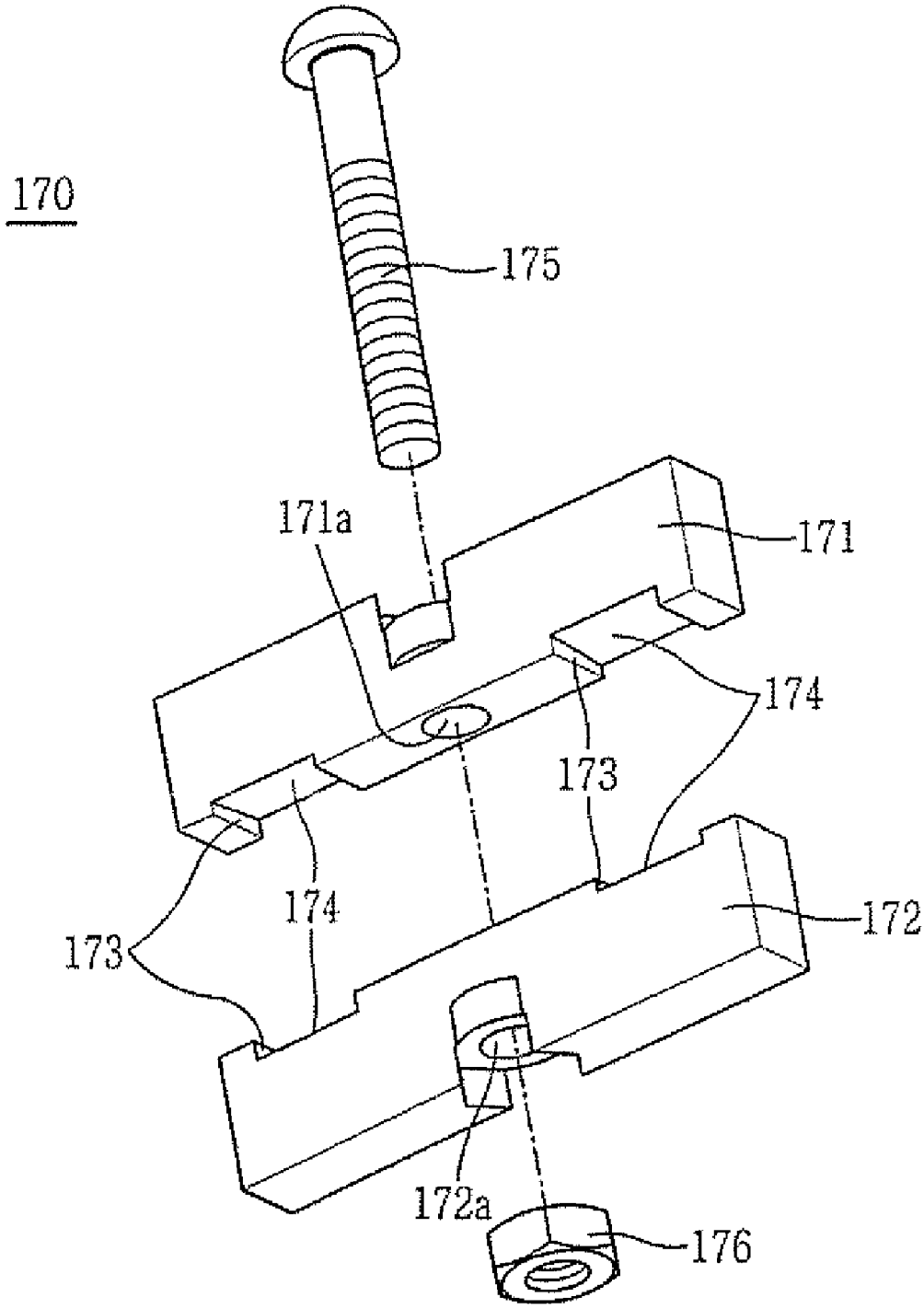
FIG. 8 is a bottom exploded perspective view showing an apparatus for preventing deformation of a driving shaft of a multi-pole circuit breaker in accordance with the present invention.
Figure 9:
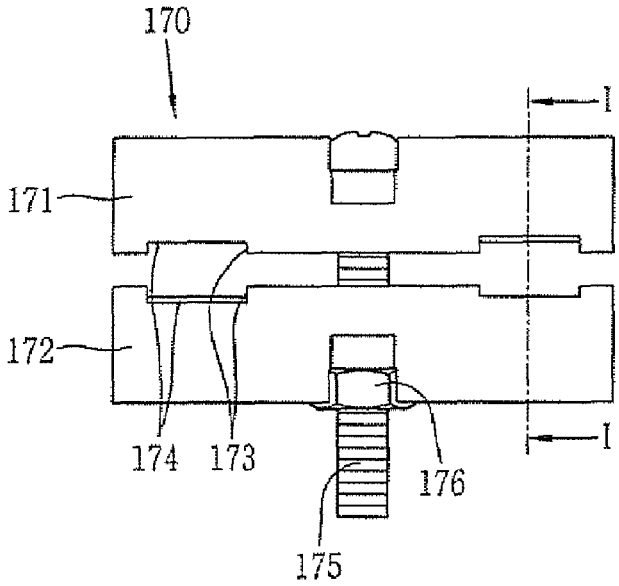
FIG. 9 is a plane view showing an apparatus for preventing deformation of a driving shaft of a multi-pole circuit breaker in accordance with the present invention.
Figure 10:
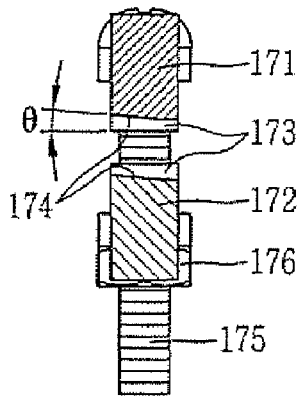
FIG. 10 is a cross sectional view take along line I-I of FIG. 9.
Figure 11:
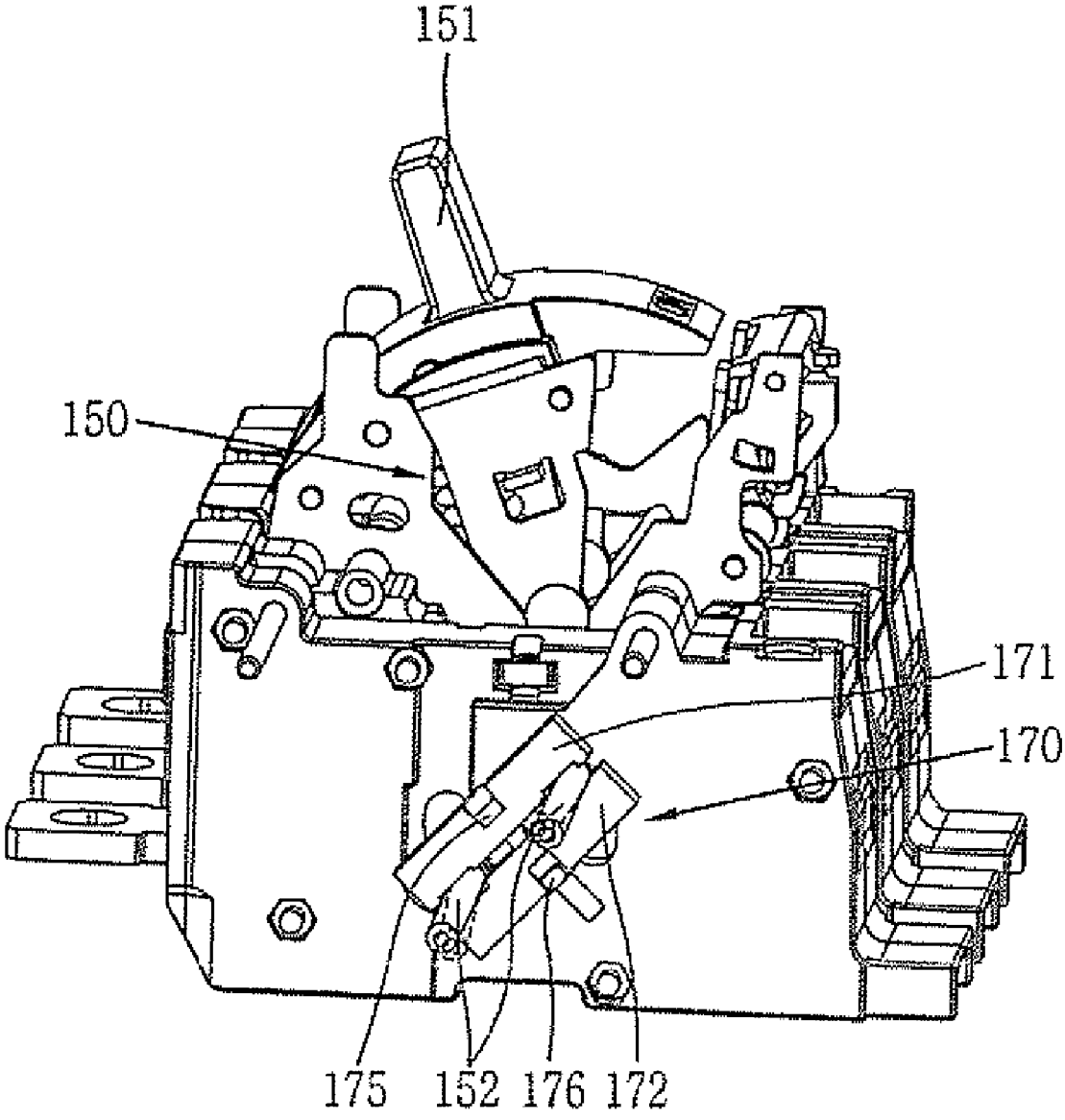
FIG. 11 is a perspective view explaining the correction of a deformed driving shaft in an apparatus for preventing deformation of a driving shaft of a multi-pole circuit breaker in accordance with the present invention.

FIGS. 5 and 6 are perspective views illustrating a multi-pole circuit breaker in accordance with the present invention, FIG. 7 is a plane view illustrating a multi-pole circuit breaker in accordance with the present invention. FIG. 8 is a bottom exploded perspective view showing an apparatus for preventing deformation of a driving shaft of a multi-pole circuit breaker in accordance with the present invention. FIG. 9 is a plane view showing an apparatus for preventing deformation of a driving shaft of a multi-pole circuit breaker in accordance with the present invention. FIG. 10 is a cross sectional view take along line I-I of FIG. 9. FIG. 11 is a perspective view explaining the correction of a deformed driving shaft in an apparatus for preventing deformation of a driving shaft of a multi-pole circuit breaker in accordance with the present invention.

Figure 1:
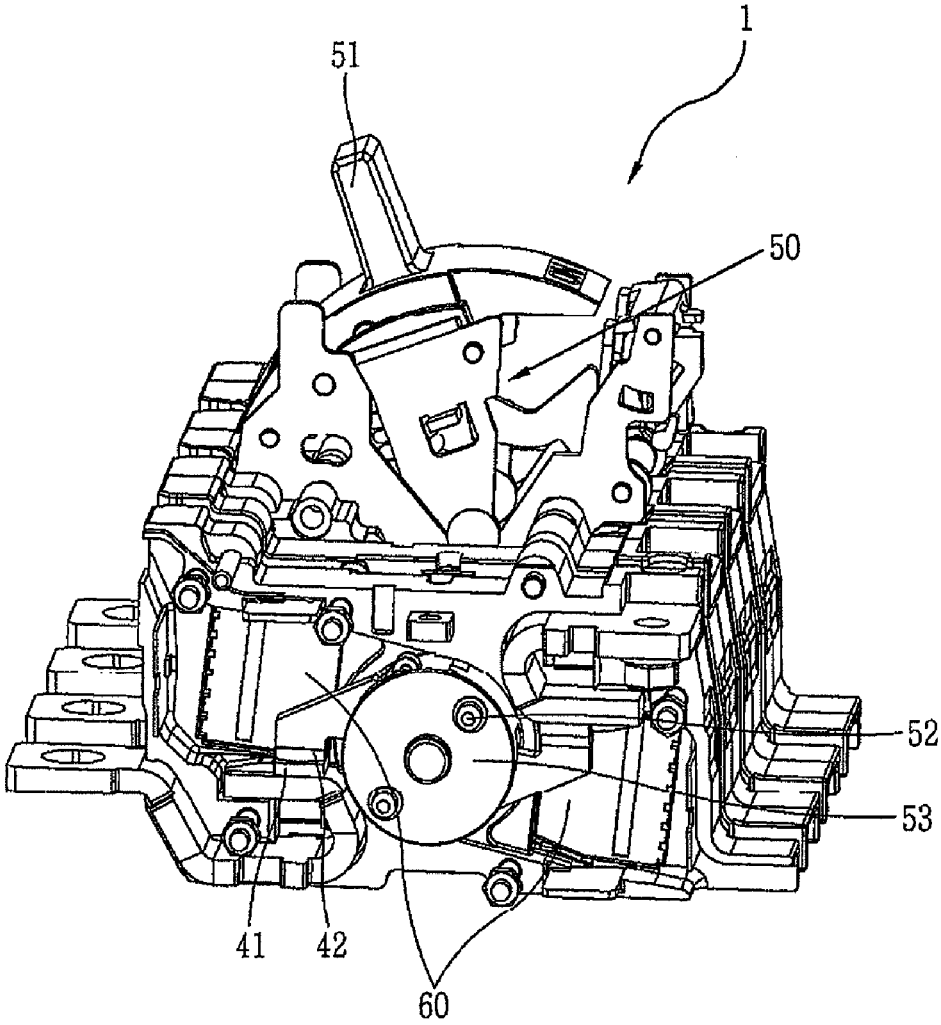
FIG. 1 CONVENTIONAL ART
FIG. 1 is a perspective view illustrating a conventional multi-pole circuit breaker.
Figure 2:
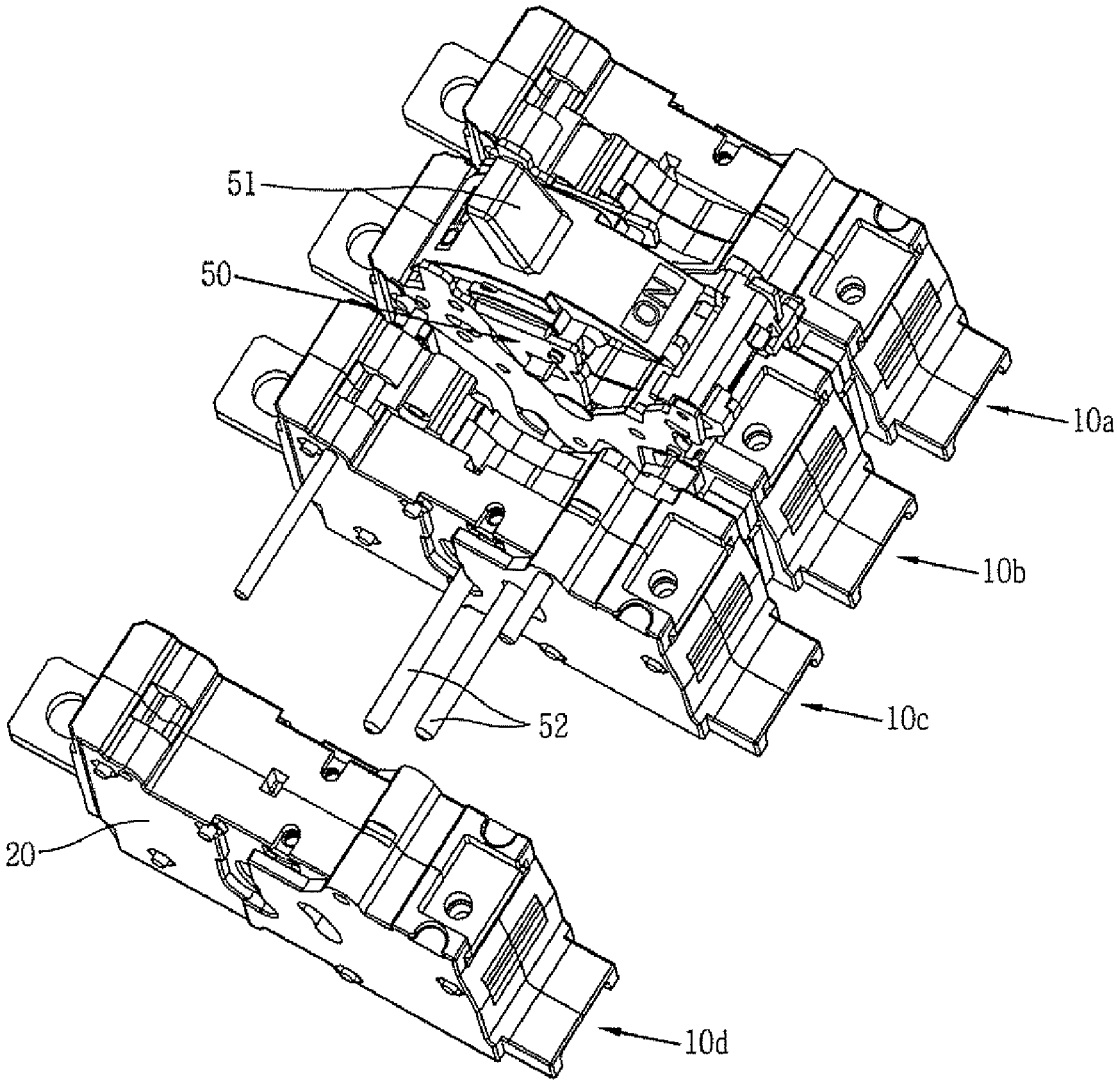
FIG. 2 CONVENTIONAL ART
FIG. 2 is an exploded perspective view illustrating a conventional multi-pole circuit breaker.
Figure 3:
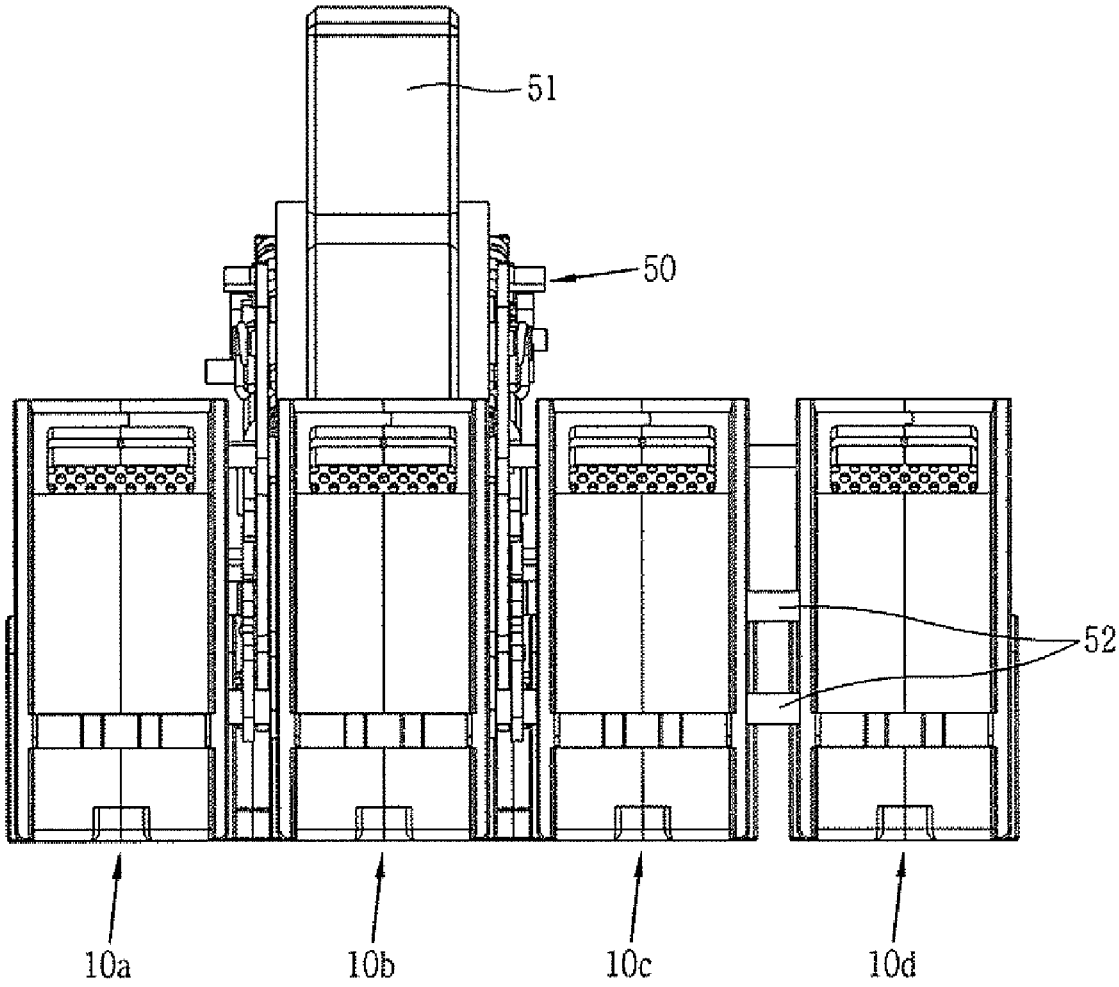
FIG. 3 CONVENTIONAL ART
FIG. 3 is a side view illustrating a conventional multi-pole circuit breaker.
Figure 4:
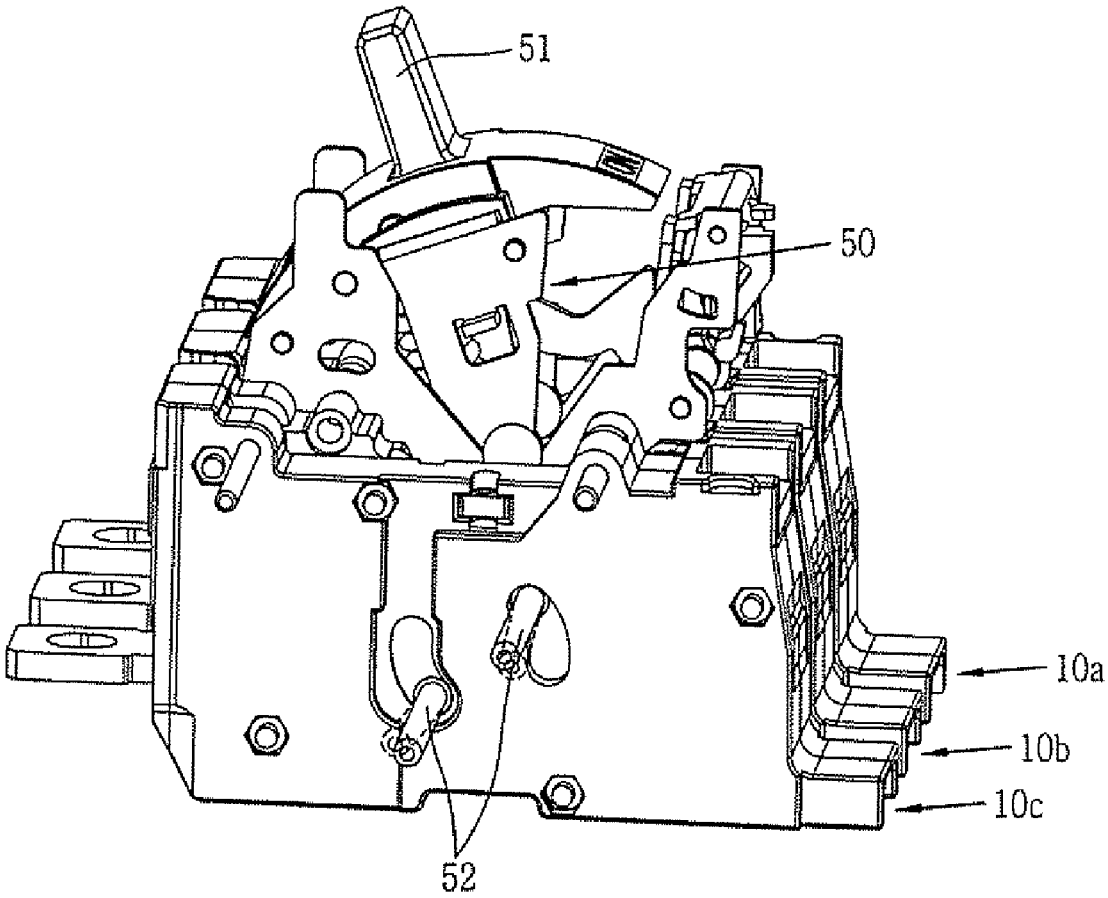
FIG. 4 CONVENTIONAL ART
FIG. 4 is a perspective view showing the deformation of a driving shaft in a conventional multi-pole circuit breaker.

In the drawings, elements, for example, a movable contactor, fixed contactors, shafts, and an arc extinguishing mechanism, having the same structure as a conventional construction, will be described with reference to FIG. 1 for convenience of explanation.

As illustrated therein, the multi-pole circuit breaker 100 in accordance with the present invention includes: a plurality of phase-based single pole breaking units 110*a*-110*d* having a pair of fixed contactors 41, a movable contactor 42 selectively contacted with the pair of fixed contactors 41, and shafts 53 for rotatably supporting the movable contactor 42; a circuit breaker body 110; a switching mechanism 150; driving shafts 152; and a driving shaft deformation prevention unit 170 for preventing deformation of the driving shafts 152.

Each of the single pole breaking units includes a case 120 having a space, fixed contactors 41 installed in the case 120 with a predetermined distance, a movable contactor 42 rotatably disposed between the fixed contactors 41 by the shafts 53, a trip mechanism (not shown) for tripping the circuit breaker by detecting a large current flowing through the circuit, a switching mechanism 150 automatically operated by the trip mechanism or manually operated by operating a handle 151, for separating the movable contactor 42 from the fixed contactors 41 thereby cutting off a circuit, and an arc extinguishing mechanism 60 for extinguishing arc gas of a high temperature and a high pressure generated between movable contactor 42 and the fixed contacts 41 at the time of switching a circuit.

The switching mechanism 150 includes a handle 151, an upper link (not shown) coupled to the trip mechanism, a lower link (not shown) coupled in conjunction with the lower part of the upper link, and driving shafts 152 for commonly connecting the lower link and the shaft 53 of each single pole breaking unit so that the shaft 53 of each single pole breaking unit can rotate in conjunction with the lower link.

The switching mechanism 150 is disposed on any one of the plurality of single pole breaking units, and serves to provide to the shafts 53 a rotation force generated upon breaking a circuit.

The pair of driving shafts 152 is coupled to each shaft 53 in order to simultaneously transmit the rotation force from the switching mechanism 150.

The driving shaft deformation prevention unit 170 is disposed between the single pole breaking unit 110*d*, spaced relatively far from the switching mechanism 150 among the plurality of single pole breaking units 110*a*-110*d*, and the adjacent single pole breaking unit 110*c* in order to prevent deformation of the driving shafts 152.

Namely, the circuit breaker body 110 has the single pole breaking unit 110*a* of R phase, the single pole breaking unit 110*b* of S phase, the single pole breaking unit 110*c* of T phase, and the single pole breaking unit 110*d* of N phase sequentially arranged therein. The switching mechanism is disposed at the single pole breaking unit of S phase, and the driving shaft deformation prevention unit 170 is disposed between the single pole breaking unit 110*d* of N phase and the single pole breaking unit 110*c* of T phase.

The apparatus for preventing deformation of a driving shaft of a multi-pole circuit breaker in accordance with a preferred embodiment of the present invention includes a pair of supporting blocks 171 and 172 positioned to face each other with the driving shafts 152 disposed therebetween, and a fastening member 175 and 176 for fastening the pair of supporting blocks 171 and 172 to each other and pressurizing the driving shafts 152 positioned between the pair of supporting blocks 171 and 172.

Holding grooves 173 for inserting the driving shafts 152 therein are formed on the opposite surfaces of the supporting blocks 171 and 172. Sloping portions 174 are formed on the opposite surfaces of the supporting blocks 171 and 172 where the holding grooves 173 are formed.

By means of a clamping force produced by a bolt 175 and a nut 176, the sloping portions 174 make deformed regions of the driving shafts 152 bent in the same direction as the rotation of the driving shafts 152, i.e., in a counterclockwise direction, thereby efficiently correcting the deformation of the driving shafts 152 caused by the switching mechanism being eccentrically disposed at the circuit breaker body 110.

The angle θ of the sloping portions 174 is preferably about 4.5 to 5.5°. That is, if the angle θ of the sloping portions 174 is less than 4.5°, a correction amount of the driving shafts 152 is small. If the angle e of the sloping portions 174 is greater than 5.5°, the driving shafts 152 may be excessively bent. Thus, it is preferable that the angle θ of the sloping portions 174 is about 4.5 to 5.5° (refer to FIG. 10).

Through holes 171*a* and 172*a* through which the fastening member 175 is to be inserted are formed at the middle of the supporting blocks 171 and 172. After inserting the fastening member, for example, the bolt 175, into the through holes 171*a* and 172*a*, the nut 176 is secured to an end portion of the bolt 175.

By the above-described construction, when the switching mechanism 150 of the circuit breaker is driven to a tripped position due to an overload or short-circuit current while the circuit breaker is in an ON state, the shafts 53 of the single pole breaking units 110*a*-110*d* coupled via the driving shafts 152 rotate in a clockwise direction as the switching mechanism 150 is driven. At this time, the movable contactor 42 is separated from the fixed contactors 41 to thereby maintain a closed circuit state.

At this time, the supporting blocks 171 and 172 of the apparatus for 170 preventing deformation of a driving shaft pressurize and support end portions of the driving shafts 152 corresponding to the regions of the supporting blocks 171 and 172 between the single pole breaking unit 110*d* of N phase and the single pole unit 110*c* of T phase, thereby effectively preventing deformation of the driving shafts (refer to FIG. 11).

In a case where the driving shafts 152 are deformed by the switching mechanism 150 being eccentrically disposed at the circuit breaker body 110, the supporting blocks 171 and 172 are tightly contacted with each other by the clamping forced produced by the bolt 175 and the nut 176. At this time, as deformed regions of the driving shafts 152 are bent in a counterclockwise direction by the sloping portions 174, they are compensated to the original position.

Therefore, the amount of rotation of the shaft 53 installed at the single pole breaking unit 110*d* of N phase is almost the same as the shafts 53 of the other single pole units 110*a*, 110*b*, and 110*c* of three phases R, S, and T. As a result, the contactors 41 and 42 of the single pole breaking unit 110*d* of N phase can be contacted with sufficient contact force or separated at a proper timing.

As seen from above, according to the present invention, the driving shaft deformation prevention unit can prevent deformation of the driving shafts as well as properly correcting deformed regions of the driving shafts, thereby improving circuit breaking performance and the reliability of the product.

What is claimed is:

1. A multi-pole circuit breaker, comprising:

a plurality of single pole breaking units having a pair of fixed contactors, a movable contactor selectively contacting the pair of fixed contactors, and shafts to rotatably support the movable contactor;

a switching mechanism disposed on one of the plurality of single pole breaking units in order to selectively cut off a circuit;

a pair of driving shafts connected to each shaft in order to simultaneously transmit a rotation force generated by the switching mechanism to the shaft of each single pole breaking unit; and a driving shaft deformation prevention unit disposed between two adjacent single pole breaking units, and the driving shaft deformation prevention unit is spaced relatively far from the switching mechanism wherein the driving shaft deformation prevention unit comprises a pair of supporting blocks provided to face each other and configured to receive the driving shafts, and each of the supporting blocks is provided with a plurality of holding grooves each having a generally planar inclined surface portion that corrects deformation of the driving shafts.

2. The multi-pole circuit breaker of claim 1, wherein the circuit breaker body has the single pole breaking unit of R phase, the single pole breaking unit of S phase, the single pole breaking unit of T phase, and the single pole breaking unit of N phase sequentially arranged therein, the switching mechanism is disposed at the single pole breaking unit of S phase, and the driving shaft deformation prevention unit is disposed between the single pole breaking unit of N phase and the single pole breaking unit of T phase.

3. The multi-pole circuit breaker of claim 1, wherein the driving shaft deformation prevention unit further comprises:

a fastening member that fastens the pair of supporting blocks to each other and pressurizing the driving shafts positioned between the pair of supporting blocks.

4. The multi-pole circuit breaker of claim 3, wherein the holding grooves to insert the driving shafts therein are formed on the opposite surfaces of the supporting blocks.

5. The multi-pole circuit breaker of claim 4, wherein the inclined surface portions are formed on the opposite surfaces of the supporting blocks where the holding grooves are formed.

6. The multi-pole circuit breaker of claim 3, wherein through holes through which the fastening member is to be inserted are formed at the middle of the supporting blocks.

7. The multi-pole circuit breaker of claim 3, wherein the fastening member comprises a bolt and a nut.

8. The multi-pole circuit breaker of claim 4, wherein through holes through which the fastening member is to be inserted are formed at the middle of the supporting blocks.

* * * * *